US007757536B2

(12) United States Patent
Ichikawa et al.

(10) Patent No.: US 7,757,536 B2
(45) Date of Patent: Jul. 20, 2010

(54) PLATE-SHAPED WORKPIECE POSITIONING STRUCTURE FOR HOT PRESS FORMING

(75) Inventors: Masanobu Ichikawa, Toyota (JP); Tatsuya Ito, Toyota (JP)

(73) Assignee: Toyoda Iron Works Co., Ltd., Toyota-shi, Aichi-ken (JP)

( * ) Notice: Subject to any disclaimer, the term of this patent is extended or adjusted under 35 U.S.C. 154(b) by 307 days.

(21) Appl. No.: 11/978,630

(22) Filed: Oct. 30, 2007

(65) Prior Publication Data

US 2008/0223105 A1 Sep. 18, 2008

(30) Foreign Application Priority Data

Mar. 13, 2007 (JP) ..... 2007-064212

(51) Int. Cl.
*B21J 13/10* (2006.01)

(52) U.S. Cl. ..... 72/420; 72/419; 72/428

(58) Field of Classification Search ..... 72/82, 72/125, 293, 347, 350, 361, 419, 420, 428, 72/31.1; 425/400

See application file for complete search history.

(56) References Cited

U.S. PATENT DOCUMENTS

| | | | | | |
|---|---|---|---|---|---|
| 2,422,883 | A | * | 6/1947 | Bruderlin | 72/60 |
| 2,997,819 | A | * | 8/1961 | Schacht | 451/510 |
| 3,700,382 | A | * | 10/1972 | Pacak | 29/892.2 |
| 3,871,095 | A | * | 3/1975 | Miyamoto et al. | 29/896.31 |
| 4,173,137 | A | * | 11/1979 | Metje | 72/320 |
| 4,805,439 | A | * | 2/1989 | Kobayashi et al. | 72/419 |
| 5,573,222 | A | * | 11/1996 | Ruehl et al. | 248/647 |

FOREIGN PATENT DOCUMENTS

| | | | |
|---|---|---|---|
| JP | 60-108123 | * | 6/1985 |
| JP | 5-123779 | * | 5/1993 |
| JP | 2006-224105 | | 3/2006 |
| WO | WO99/07492 | | 2/1999 |

* cited by examiner

*Primary Examiner*—Edward Tolan
(74) *Attorney, Agent, or Firm*—Finnegan, Henderson, Farabow, Garrett & Dunner, LLP

(57) ABSTRACT

The present invention provides a plate-shaped workpiece positioning structure for hot press forming that, upon executing a hot press forming of a heated plate-shaped workpiece (16), positions the plate-shaped workpiece relative to a pair of press dies (10, 12, 14). The positioning structure includes (a) a first positioning opening (20*b*) and (b) a second positioning openings (22*a*, 22*c*). The first positioning opening is arranged in a center part of the plate-shaped workpiece, and engages with a first positioning pin (22*b*) provided on one (12) of the pair of press dies to position the plate-shaped workpiece. The second positioning openings are arranged between the first positioning opening and a predetermined outer peripheral parts (16*a*, 16*b*) of the plate-shaped workpiece, and are formed in an elongate shape that extends along a line connecting the first positioning opening and the predetermined outer peripheral part of the plate-shaped workpiece. The second positioning openings engage with a second positioning pins (22*a*, 22*c*) provided on one (12) of the pair of press dies. Thus, the plate-shaped workpiece is positioned in a circumferential direction about the first positioning opening of the plate-shaped workpiece. Additionally, the plate-shaped workpiece can contractionally deform toward the first positioning opening upon executing the hot press forming of the heated plate-shaped workpiece.

9 Claims, 5 Drawing Sheets

PILOT PIN POSITION

PILOT OPENING POSITION(UPON HEATING IN 850 ℃)

PILOT OPENING POSITION(UPON COOLING AND AFTER HEATING)

PLATE-SHAPED WORKPIECE POSITIONING STRUCTURE FOR HOT PRESS FORMING

The present application is based on Patent Application No. 2007-064212 filed in Japan, the content of which is incorporated herein by way of reference.

BACKGROUND OF THE INVENTION

1. Field of the Invention

The present invention relates to a hot press forming, and in particular to improvement of a plate-shaped workpiece positioning structure that positions a plate-shaped workpiece relative to a press die.

2. Description of Related Art

A positioning structure that, when a heated plate-shaped workpiece is subjected to a hot press forming, positions the plate-shaped workpiece relative to a press die and that has both (a) a first positioning opening and (b) a second positioning opening. The first positioning opening i.e., positioning hole is arranged at a predetermined position in the plate-shaped workpiece to engage with a first positioning pin that is provided on the press die i.e., press mould. The second positioning opening i.e., positioning hole is arranged at a predetermined position that is spaced away from the first positioning opening, and is formed in an elongate shape to engage with a second positioning pin that is disposed in the press die. These first and second positioning openings operate to position the plate-shaped workpiece in a predetermined posture. Patent Document 1 discloses one example of a positioning structure that has an elongate second positioning opening accommodating thermal expansion and dimensional variations in the plate-shaped workpiece.

In addition to this, both the first and second positioning pins that engage with these openings are arranged to be able to protrude from and retract into the press die. The first and second positioning pins move to the protruded positions prior to the hot press forming in order to position the plate-shaped workpiece, and subsequently, prior to the hot press forming, they retract into their retracted positions. In this way, the first and second positioning pins allow the plate-shaped workpiece to be cooled and contractionally deformed with being kept in a press formed state, that is in a state tightly held by the press die, in the hot press forming.

Patent Document 1: Japanese Patent Publication No. 2006-224105.

However, in such known positioning structure, since the positioning pins retract during the hot press forming, the plate-shaped workpiece moves freely upon formation by the press die. Accordingly, depending on the forming shape, the plate-shaped workpiece may deviate when it is subjected to the press forming. In the hot press forming, the plate-shaped workpiece at high temperature is subjected to the press forming using the press die at low temperature to achieve forming and quenching at the same time. For this reason, the hot press forming is normally executed as a final process after trimming and so on were executed. Consequently, the aforementioned positional deviation of the plate-shaped workpiece may directly leads to defectiveness of the plate-shaped workpiece.

In addition to this, due to location of the aforementioned first positioning opening spaced away from a center of the plate-shaped workpiece, the position of the first positioning opening relative to an entire shape tends to deviate by thermal expansion and deformation of the plate-shaped workpiece caused with heating. Even when the position of the plate-shaped workpiece does not deviate during the press forming, high dimensional accuracy i.e., precision thereof can hardly achieved. In other words, the plate-shaped workpiece deforms symmetrically with respect to the center thereof during the thermal expansion, transformation and contraction due to cooling of the plate-shaped workpiece. If the first positioning opening is arranged at the position that is deviated from the center of the plate-shaped workpiece, expansion and deformation due to heat deteriorates i.e., degrades the positioning of the first positioning opening. As a result, positioning accuracy and forming accuracy of the plate-shaped workpiece deteriorate.

Furthermore, due to requirement of the protrusion/retraction mechanism for positioning pin, the positioning structure tends to be complicated and costly. In addition to this, these positioning pins are required to protrude/retract in every hot press forming process cycle, which lengthens each cycle time to restrict the forming efficiency, and requires maintenance for abrasion of movable parts to increase the forming costs.

The present invention has been developed in consideration of the above circumstances, and has the object to eliminate the requirement for the positioning pin to protrude/retract, to construct the forming device simply at low cost, and to restrict any positional deviation of the plate-shaped workpiece for achieving the high forming accuracy.

SUMMARY OF THE INVENTION

In order to achieve the above object, a first aspect i.e., first invention relates to a plate-shaped workpiece positioning structure for hot press forming that, upon executing a hot press forming of a heated plate-shaped workpiece, positions the plate-shaped workpiece relative to a press die, the positioning structure comprising: (a) a first positioning opening arranged in a center part of the plate-shaped workpiece, the first positioning opening engaging with a first positioning pin provided on the press die to position the plate-shaped workpiece; and (b) a second positioning opening arranged between the first positioning opening and a predetermined outer peripheral part of the plate-shaped workpiece and is formed in an elongate shape that extends along a line connecting the first positioning opening and the predetermined outer peripheral part, the second positioning opening engaging with a second positioning pin provided on the press die, to position the plate-shaped workpiece in a circumferential direction about the first positioning opening, and to allow contractional deformation of the plate-shaped workpiece toward the first positioning opening upon executing the hot press forming.

A second aspect i.e., second invention relates to a plate-shaped workpiece positioning structure for hot press forming that, upon executing a hot press forming of an elongate heated plate-shaped workpiece, positions the plate-shaped workpiece relative to a press die, the positioning structure comprising: (a) a first positioning opening arranged in a center part in a longitudinal direction of the plate-shaped workpiece, the first positioning opening engaging with a first positioning pin provided on the press die to position the plate-shaped workpiece in the longitudinal direction thereof; and (b) a second positioning opening arranged between the first positioning opening and a longitudinally distal end of the plate-shaped workpiece and is formed in an elongate shape extending in the longitudinal direction, the second positioning opening engaging with a second positioning pin provided on the press die to position the plate-shaped workpiece in a shorter direction, and to allow contractional deformation in the longitudinal direction of the plate-shaped workpiece toward the first positioning opening upon executing the hot press forming.

A third aspect i.e., third invention is featured by, in the plate-shaped workpiece positioning structure for hot press forming in the second aspect, a pair of the second positioning openings are arranged at opposite positions in the longitudinal direction of the plate-shaped workpiece with interposing the first positioning opening therebetween, and engages with a pair of the second positioning pins provided on the press die, to position the plate-shaped workpiece in the shorter direction, and to allow contractional deformation of the plate-shaped workpiece in the longitudinal direction toward the first positioning opening upon the hot press forming.

A fourth aspect i.e., fourth invention is featured by, in the plate-shaped workpiece positioning structure for hot press forming in any of the first to third aspects, both the first positioning pin and the second positioning pin are fixed on the press die integrally therewith.

A fifth aspect i.e., fifth invention is featured by, in the plate-shaped workpiece positioning structure for hot press forming in any of the first to fourth aspects, the first positioning opening has a true circular shape with a fixed diameter.

In the plate-shaped workpiece positioning structure for hot press forming according to the first aspect of the present invention, the first positioning opening is arranged in the center part of the plate-shaped workpiece that is less affected by a dimensional change due to thermal expansion by heat and contraction during the hot press forming. Accordingly, positioning accuracy of the first positioning opening relative to the plate-shaped workpiece is kept high, so that the heated plate-shaped workpiece can be positioned with high accuracy relative to the press die. In addition to this, when the plate-shaped workpiece is subjected to the hot press forming with the first positioning opening being kept in engagement with the first positioning pin, during transformation and contraction due to cooling of the plate-shaped workpiece, no large load is applied therebetween. Therefore, deformation or the like due to such load is less likely to occur.

On the other hand, the second positioning opening that positions i.e., determines posture of the plate-shaped workpiece, in cooperation with the first positioning opening, is arranged between the first positioning opening and the predetermined outer peripheral part of the plate-shaped workpiece. The second positioning opening is formed in an elongate shape that extends along a line connecting the first positioning opening and the predetermined outer peripheral part. The second positioning openings operate to position the plate-shaped workpiece in a circumferential direction about the first positioning opening of the plate-shaped workpiece, and additionally allow deformation upon contraction, that is contractional deformation of the plate-shaped workpiece toward the first positioning opening, during the hot press forming of the plate-shaped workpiece. With this, the plate-shaped workpiece can be subjected to the hot press forming with the second positioning opening being kept in engagement with the second positioning pin.

As stated above, the first positioning opening can position the plate-shaped workpiece relative to the press die with high accuracy. In addition to this, the plate-shaped workpiece can be subjected to the hot press forming with the first and second positioning openings being kept in engagement with the first and second positioning pins, respectively. Accordingly, any positional deviation of the plate-shaped workpiece is prevented during the press forming thereof, so that the high forming accuracy over an entire press forming can be achieved.

In addition to this, the hot press forming can be executed with the first and second positioning openings being kept in engagement with the first and second positioning pins, respectively, as stated above. Accordingly, when compared with the case where the positioning pins protrude/retract in every hot press forming process cycle, the cycle time of the hot press forming process is shortened, which results in improvement in the forming efficiency. Additionally, a reduction of movable parts decreases maintenance work, which decreases the forming costs. Furthermore, because the positioning pins are not required to be able to protrude from and retract into the press die, they can be arranged fixedly on and integrally with the press die, as detailed in the fourth aspect of the present invention. Thus, a forming device can be simply constructed at low cost.

In the plate-shaped workpiece positioning structure for hot press forming according to the second aspect of the present invention, the first positioning opening is arranged in the central part in a longitudinal direction of the plate-shaped workpiece that is less affected by any dimensional change due to thermal expansion by heating and contraction during the hot press forming. Accordingly, the positioning accuracy i.e., locating accuracy of the first positioning opening relative to the plate-shaped workpiece is maintained high, which results in high and accurate positioning of the heated plate-shaped workpiece relative to the press die. In addition to this, when the plate-shaped workpiece is subjected to the hot press forming with the first positioning opening being kept in engagement with the first positioning pin during transformation and contraction due to cooling of the plate-shaped workpiece, no large load is applied therebetween. Thus, deformation or the like due to such a load is unlikely to occur.

Additionally, the second positioning opening that determines i.e., positions posture of the plate-shaped workpiece, in cooperation with the first positioning opening, is arranged between the first positioning opening and a longitudinal distal end of the plate-shaped workpiece. The second positioning opening is formed in an elongate shape extending in the longitudinal direction. The first and second positioning openings position the plate-shaped workpiece in a shorter direction, and additionally allow contractional deformation of the plate-shaped workpiece in the longitudinal direction toward the first positioning opening, upon the hot press forming of the plate-shaped workpiece. Accordingly, the plate-shaped workpiece can be subjected to the hot press forming with the second positioning opening being kept in engagement with the second positioning pin. As a result, this second invention can render operation and effect similar to that of the first invention.

The hot press forming according to the present invention is suitably applied to a forming process for manufacturing various types of press-formed parts for vehicles, such as vehicle bumper reinforcements, vehicle door impact protection beams, center pillar reinforcements, and press-formed parts for uses other than in vehicles. The second invention is applied to the hot press forming process for an elongate plate-shaped workpiece. In the first invention, shape of the plate-shaped workpiece is not specifically limited. The first invention can be applied to the hot press forming process for the plate-shaped workpiece that can have various shapes such as a disc shape, a square shape, or a regular polygonal shape, and the like.

Hot press forming is a technique that subjects the plate-shaped workpiece heated to temperature of an austenite range, using the press die at low temperature to be formed into a predetermined shape, and simultaneously to cooling the plate-shaped workpiece to cause the martensite transformation for hardening it. By holding and cooling the plate-shaped workpiece with keeping it in the formed state (tightly-held state) by the press die for a predetermined time period, the plate-shaped workpiece is kept in the predetermined shape, irrespective of any transformation or contraction due to cooling of the plate-shaped workpiece. Dimension of the second positioning opening is selected to allow contractional deformation in this time period. In a heated state prior to the hot press forming, the second positioning opening engages with the second positioning pin to provide play (clearance for allowing contractional deformation) on the outer peripheral side or the longitudinally distal end side of the plate-shaped workpiece.

The first and second positioning pins preferably have a cylindrical shape i.e., pillar shape with a cone-shaped end, or a prism shape with a pyramid-shaped end, for example. A cylindrical shape preferably has a true circular shape in the cross-sectional view with a fixed diameter. A prism shape preferably has a regular triangle, square or regular polygon in the cross-sectional view.

The first positioning opening preferably has a true circular shape with a fixed diameter as detailed in the fifth aspect of the present invention. However, as detailed in the third aspect of the present invention, when a pair of second positioning openings are provided in the elongate plate-shaped workpiece, for example, the first positioning opening can be formed in an elongate shape (e.g., an elliptical shape, or a rectangular shape) that extends in the shorter direction. Also, in the first invention, when two or more second positioning openings are formed so that the plate-shaped workpiece can be positioned at a predetermined position in a predetermined posture, an elongate opening can also be adopted as the first positioning opening.

The second positioning opening can be formed in an elongate shape such as an elliptical shape, a rectangular shape or the like, and two or more second positioning openings can be provided. In carrying out the first invention, three or more second positioning openings can be arranged to extend radially from the center of the first positioning opening. Additionally, location and the number of the second positioning opening(s) are suitably selected depending on shape of the plate-shaped workpiece. The first and second positioning openings are preferably dimensioned in consideration of any dimensional variations, holing accuracy of the positioning opening, linear expansivity variations and so on, of the plate-shaped workpiece In the second aspect of the present invention that forms the elongate plate-shaped workpiece, the first positioning opening is arranged in the center part in the longitudinal direction of the plate-shaped workpiece. Thus, arrangement of the first positioning opening is not specified in the shorter direction. However, when a dimensional change due to thermal expansion and contraction in the shorter direction causes a problem, that is when such dimensional change is large, the first positioning opening is preferably arranged in a center part also in the shorter direction of the plate-shaped workpiece. Here, noted that the center part does not always means a geometric center, but in a range that is less affected by dimensional change due to thermal expansion and contraction.

In other words, although dependent on the size, shape, linear expansivity and so on of the plate-shaped workpiece, the center of the opening can be located in a range not more than 15% of the dimension between the center and the outer periphery or the longitudinal end of the plate-shaped workpiece. The center of the opening is preferably located in a range not more than 10% of the above dimension. This is true for the first aspect of the present invention.

BRIEF DESCRIPTION OF THE DRAWINGS

FIGS. 1A and 1B are explanatory views explaining a plate-shaped workpiece positioning structure for executing a hot press forming in which the present invention is adopted, wherein FIG. 1A is a cross-sectional view of a press die taken along a line 1B-1B shown in FIG. 1B, and FIG. 1B is a plan view of the plate-shaped workpiece that is mounted on a lower die;

FIGS. 4A and 4B are explanatory views explaining an another embodiment according to the present invention and corresponding to FIGS. 1A and 1B, wherein FIG. 4A is a cross-sectional view of a press die taken along a line 4B-4B shown in FIG. 4B, and FIG. 4B is a plan view of a plate-shaped workpiece that is mounted on a lower die; and FIGS. 5A and 5B are explanatory views explaining yet another embodiment according to the present invention and corresponding to FIGS. 1A and 1B, wherein FIG. 5A is a cross-sectional view of a press die taken along a line 5B-5B shown in FIG. 5B, and FIG. 5B is a plan view of a plate-shaped workpiece that is mounted on a lower die.

DETAILED DESCRIPTION OF THE PREFERRED EMBODIMENTS

In the following, embodiments of the present invention will be described with reference to the drawings.

Figure 1A:
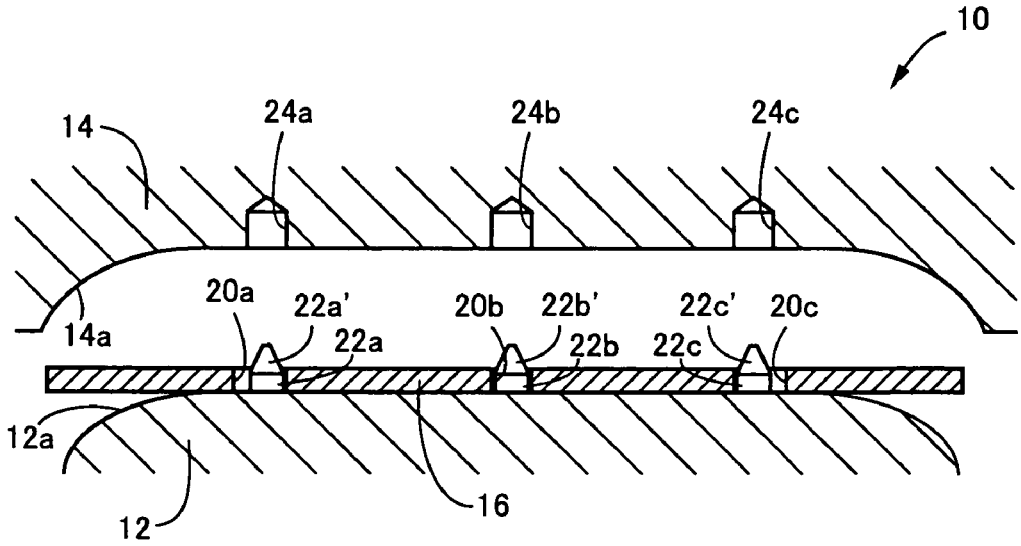
Figure 1B:
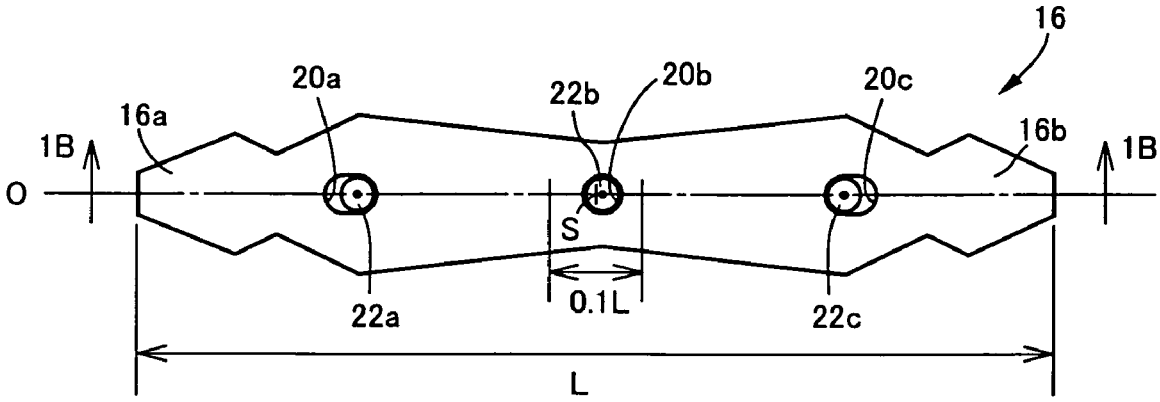

FIGS. 1A and 1B are schematic views explaining a press die 10 for executing a hot press forming. The press die 10 includes a pair of dies, i.e., a lower die 12 and an upper die 14. The lower die 12 corresponding to the claimed one of the paired press dies has a convex-shaped forming surface 12*a*, and the upper die 14 corresponding to the claimed other of the paired press dies has a concaved-shaped forming surface 14*a* accommodating the convex-shaped forming surface 12*a*. A driving device (not shown) drives the upper die 14 upward and downward to move it closer to and away from the lower die 12. The lower and upper dies 12 and 14 sandwich with pressure a plate-shaped workpiece 16 therebetween to subject the plate-shaped workpiece 16 to a press forming and to a quenching by rapidly cooling. FIGS. 1A and 1B are views showing the state where the plate-shaped workpiece 16 is mounted and positioned on the lower die 12. FIG. 1A is a cross-sectional view. FIG. 1B is a plan view showing the plate-shaped workpiece 16 that is mounted on the lower die 12. FIG. 1A corresponds to the cross-sectional view taken along the line 1B-1B shown in FIG. 1B.

The plate-shaped workpiece 16 is used to produce vehicle bumper reinforcements, and has an elongate shape that extends in the right-to-left direction in these drawings. The plate-shaped workpiece 16 is previously heated to approximately 850° C., and thus is held in an austenite state. The lower and upper dies 12 and 14 for executing the hot press forming are held at low temperature by a cooling-liquid passage (not shown) so that the plate-shaped workpiece 16 that was already subjected to the press forming is rapidly cooled to be transformed into a martensite state within a short time period, e.g., approximately 5-10 seconds, to 100° C. or less.

The plate-shaped workpiece 16 has a symmetrical shape relative to a center line O which is located at a center in a shorter direction (a top-to-bottom direction in FIG. 1B). On the center line O, three pilot openings 20*a*, 20*b* and 20*c* are formed with uniformly spaced i.e., equidistantly in an aligned state of the center line O, to position the plate-shaped workpiece 16. The center pilot opening 20*b* serving as a claimed first positioning opening, has a true circular shape with a fixed diameter. A center of the center pilot opening 20*b* is located in a center part in the longer direction i.e., longitudinal direction (left-to-right direction in FIG. 1B) of the plate-shaped workpiece 16, specifically, in a range that lies on both sides of the center S in the longitudinal direction and is not more than 10% of the length L in the longitudinal direction. A pilot pin 22*b* is inserted into this pilot opening 20*b*, so that the center part of the plate-shaped workpiece 16 is positioned. The pilot pin 22*b* is provided fixedly on and integrally with the lower die 12 to protrude upward.

The pilot pin 22*b* serving as a claimed first positioning pin of the present invention, has a cylindrical shape i.e., pillar shape with a cone-shaped end 22*b*'. Engagement of cone-shaped end 22*b*' of the pilot pin 22*b* with the pilot opening (more correctly, an inner periphery) 20*b* displaces the plate-shaped workpiece 16 for the positioning thereof so that the pilot opening 20*b* thereof is located substantially concentrically with the pilot pin 22*b*. The pilot pin 22*b* has a true circular shape in the cross-sectional view with a diameter that is either the same or slightly smaller than the diameter of the pilot opening 20*b*.

The pilot openings 20*a* and 20*c* formed at opposite ends on the plate-shaped workpiece 16 serve as the second positioning openings of the present invention. Both the pilot openings 20*a* and 20*c* are formed in an elongate shape that extends in the longitudinal direction. Each of the pilot openings 20*a* and 20*c* is arranged between the aforementioned pilot opening 20*b* and each of distal ends 16*a* and 16*b* (outer peripheral part) in the longitudinal direction of the plate-shaped workpiece 16. Into these pilot opening 20*a* and 20*c*, pilot pins 22*a* and 22*c* that are provided fixedly on and integrally with the lower die 12 to protrude upward are inserted. With this, the plate-shaped workpiece 16 is positioned in the short direction perpendicular to the longitudinal direction. Engagement of the pilot openings 20*a* and 20*c* with the pilot pins 22*a* and 22*c*, in cooperation with the engagement of the aforementioned pilot opening 20*b* with the pilot pin 22*b*, determines the plate-shaped workpiece 16 at a predetermined position in a predetermined posture.

The pilot pins 22*a* and 22*c* serving as claimed second positioning pins of the present invention, have a cylindrical shape i.e., pillar shape with a cone-shaped end 22*a*, 22*c*. Engagement of the cone-shaped ends 22*a* and 22*c* of the pilot pins 22*a* and 22*c* with the pilot openings (more correctly, an inner peripheries) 20*a* and 20*c* displaces the plate-shaped workpiece 16 for the positioning thereof so that the pilot pins 22*a* and 22*c* are inserted into the pilot openings 20*a* and 20*c*, respectively. The pilot pins 22*a* and 22*c* have a true circular shape in the cross-sectional view with a diameter that is either the same or slightly smaller than the width (diameter of the arc on both sides) of the pilot openings 20*a* and 20*c*. In this embodiment, all the pilot pins 22*a*, 22*b* and 22*c* have the same shape with the same dimensions.

The length dimension (length dimension in the longitudinal direction of the plate-shaped workpiece 16) of the aforementioned pilot openings 20*a* and 20*c* is selected based on the linear expansivity of the plate-shaped workpiece 16, spaced dimension away from the pilot opening 20*b*, variations in the linear expansivity and the spaced dimension, and so on as follows. That is, the length dimension of the pilot openings 20*a* and 20*c* is selected to allow the plate-shaped workpiece 16 to contractionally deform during cooling thereof upon the hot press forming, toward the center in the longitudinal direction, that is toward the pilot opening 20*b* positioned by the pilot pin 22*b*. As shown in FIGS. 1A and 1B, in a heated state prior to the hot press forming, the pilot openings 20*a* and 20*c* engage with the pilot pins 22*a* and 22*c* to provide i.e., to leave play (clearance allowing contractional deformation) at distal end sides in the longitudinal direction of the plate-shaped workpiece 16. In other words, of the inner peripheries of the pilot openings 20 and 20*c*, parts near to i.e., at side of the pilot opening 20*b* engage with the pilot pins 22*a* and 22*c*.

Hot press forming completes when the plate-shaped workpiece 16 is sandwiched between the pair of lower and upper dies 12 and 14 and is rapidly cooled, to be transformed into martensite and to be contractionally deformed. In this state, as shown in FIG. 2C, play is provided in the pilot openings 20*a* and 20*c* at the center sides in the longitudinal direction of the plate-shaped workpiece 16, that is on the sides near to the pilot opening 20*b*.

Figure 2A:
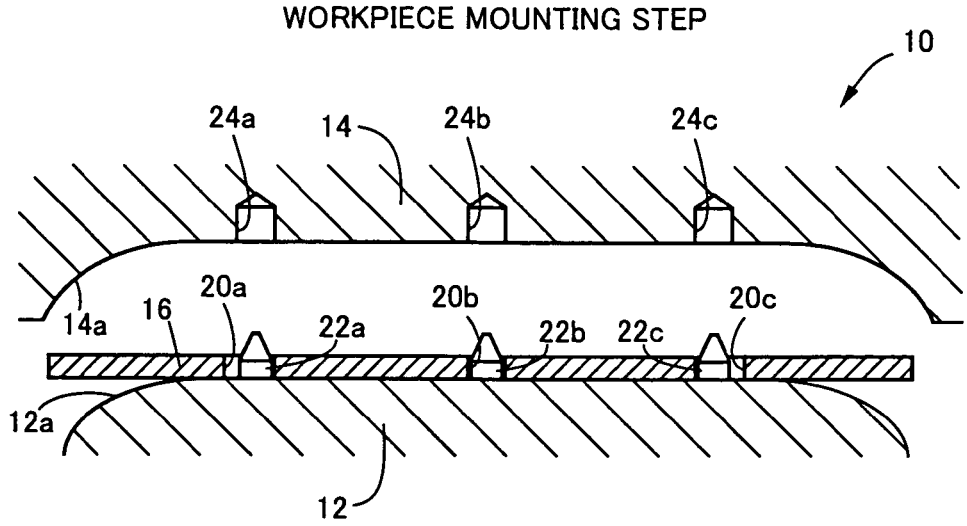
FIGS. 2A-2C are explanatory views explaining forming steps undertaken during the hot press forming by means of the press die shown in FIG. 1A.
Figure 2B:
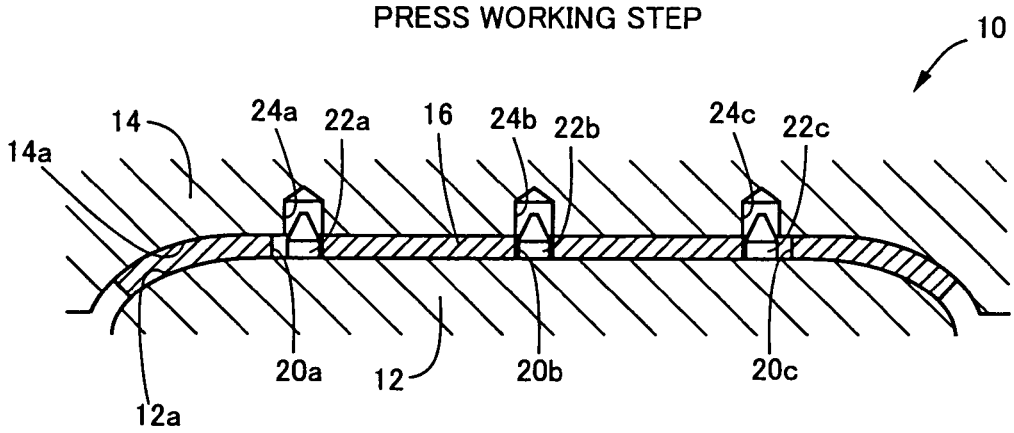
Figure 2C:
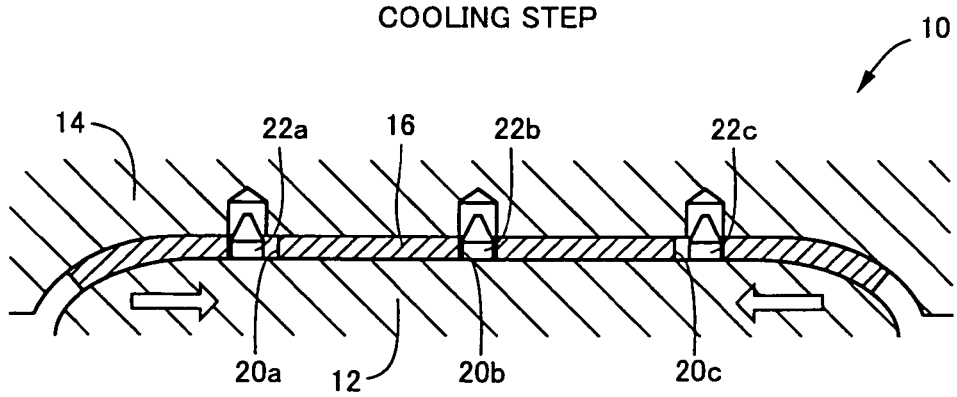

FIGS. 2A-2C are explanatory views explaining various steps during the hot press forming. FIG. 2A shows a workpiece mounting step similar to the state shown in FIGS. 1A and 1B. In this step, a loading device supplies the plate-shaped workpiece 16 on the lower die 12 so that the pilot pins 22*a*, 22*b* and 22*c* that are fixedly provided on the lower die 12 engage with the pilot openings 20*a*, 20*b* and 20*c*. In this way, the plate-shaped workpiece 16 is positioned at a predetermined position in a predetermined posture on the lower die 12 which is preset.

FIG. 2B shows a press forming step that the upper die 14 is lowered to sandwich with pressure the plate-shaped workpiece 16 together with the lower die 12. In this press forming step, the plate-shaped workpiece 16 is subjected to the press forming to be formed into a predetermined shape. FIG. 2B shows the state immediately after the timing when the upper die 14 reaches a lower end of stroke, in other words, immediately after the press forming. Owing to the press forming under engagement of the pilot pins 22*a*, 22*b* and 22*c* with the pilot openings 20*a*, 20*b* and 20*c*, the plate-shaped workpiece 16 does not suffer from any positional deviation upon the press forming thereof, so that the high forming accuracy is achieved. In addition to this, escape openings 24*a*, 24*b* and 24*c* are provided on the upper die 14 at positions corresponding to the pilot pins 22*a*, 22*b* and 22*c*. Thus, interfere of the upper die 14 with the pilot pins 22*a*, 22*b* and 22*c* that protrude upward from the plate-shaped workpiece 16 is avoided.

FIG. 2C shows a cooling step executed to harden the plate-shaped workpiece 16. That is, the plate-shaped workpiece 16 is cooled for a predetermined time period with kept in a press formed state where the plate-shaped workpiece 16 is sandwiched between the lower and upper dies 12 and 14. With this, the plate-shaped workpiece 16 is subjected to the martensite transformation to be hardened with kept in a predetermined shape, irrespective of transformation and contractional deformation of the plate-shaped workpiece 16 due to cooling thereof. In this cooling step, contractional deformation of the plate-shaped workpiece 16 displaces the opposite ends in the longitudinal direction toward the center thereof, as shown by the hollow arrows, which is allowed by the elongate pilot openings 20*a* and 20*c*.

Contractional deformation hardly occurs at the center part of the plate-shaped workpiece 16. For this reason, in spite of absence of play between the pilot pin 22*b* and pilot opening

20*b*, a large load (stress) is unlikely to be applied between them, or the plate-shaped workpiece 16 is unlikely to be deformed. After this cooling step, the upper die 14 is lifted for dismounting the plate-shaped workpiece 16 that is formed into a desired shape by the hot press forming.

Figure 3A:
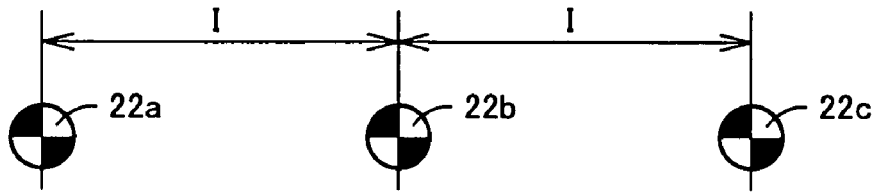
FIGS. 3A-3C are explanation views explaining positional relationship between pilot pins of the press die and pilot openings that are disposed on the plate-shaped workpiece shown in FIG. 1A.
Figure 3B:
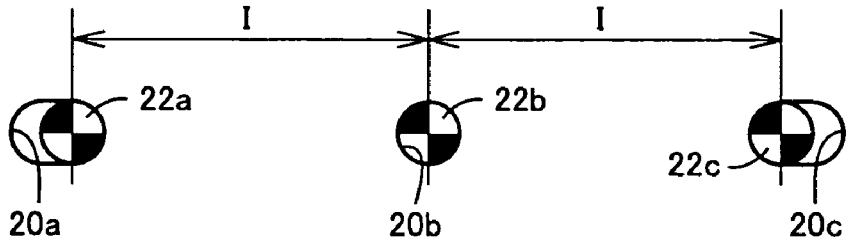
Figure 3C:
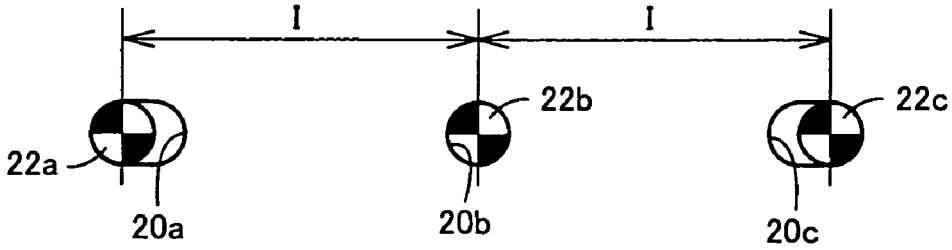

FIGS. 3A-3C are explanatory views showing the positional relationship between the aforementioned pilot pins 22*a*, 22*b* and 22*c* and the pilot openings 20*a*, 20*b* and 20*c*. FIG. 3A is a view showing the pilot pins 22*a*, 22*b* and 22*c* that are provided equidistantly, in other words, spaced at equal intervals "I" away from each other. FIG. 3B shows the positional relationship between the pilot pins 22*a*, 22*b* and 22*c* and the pilot openings 20*a*, 20*b* and 20*c* in the heated state of the plate-shaped workpiece 16, that is, in the state shown in FIGS. 2A and 2B. The elongate pilot openings 20*a* and 20*c* at the opposite ends engage with the pilot pins 22*a* and 22*c* to provide play at the distal end sides in the longitudinal direction of the plate-shaped workpiece 16.

FIG. 3C shows the positional relationship between the pilot pins 22*a*, 22*b* and 22*c* and the pilot openings 20*a*, 20*b* and 20*c* during cooling or after completion of the hot press forming, that is, in the state shown in FIG. 2C. The elongate pilot openings 20*a* and 20*c* at opposite ends displaced relative to the pilot pins 22*a* and 22*c* so that play is provided on the center side in the longitudinal direction of plate-shaped workpiece 16, that is, near to the pilot opening 20*b*.

In the positioning structure for the plate-shaped workpiece 16 used in the hot press forming according to the present embodiment, the center pilot opening 20*b* is selected to locate in a center part in the longitudinal direction of the plate-shaped workpiece 16. The center part is less likely to be affected by a dimensional change due to thermal expansion by heat and contraction during the hot press forming. For this reason, the positioning accuracy of the pilot opening 20*b* relative to the plate-shaped workpiece 16 is kept in the high condition, so that the heated plate-shaped workpiece 16 can be positioned with high accuracy relative to the press die 10. In addition to this, when the plate-shaped workpiece 16 is subjected to the hot press forming with the pilot opening 20*b* being kept in engagement with the pilot pin 22*b*, even during transformation and contraction due to cooling of the plate-shaped workpiece 16, no large load is applied between the pilot opening 20*b* and the pilot pin 22*b*. Therefore, deformation or the like due to such a load is unlikely to occur.

On the other hand, the pilot openings 20*a* and 20*c* that determines posture of the plate-shaped workpiece 16, in cooperation with the pilot opening 20*b*, are arranged between the pilot opening 20*b* and the longitudinally distal ends 16*a* and 16*b* of the plate-shaped workpiece 16. The pilot openings 20*a* and 20*c* are formed in an elongate shape extending in the longitudinal direction. The pilot openings 20*a* and 20*c* position the plate-shaped workpiece 16 in the shorter direction, and additionally allow contractional deformation in the longitudinal direction of the plate-shaped workpiece 16 toward its center, that is, toward the pilot opening 20*b* when the plate-shaped workpiece 16 is subjected to the hot press forming. Accordingly, the hot press forming can be executed with keeping engaged state of the pilot openings 20*a* and 20*c* with the pilot pins 22*a* and 22*c*.

As discussed above, the pilot opening 20*b* can position the plate-shaped workpiece 16 relative to the press die 10 with high accuracy. Hot press forming can be executed with the pilot openings 20*a*, 20*b* and 20*c* including the pilot opening 20*b* being kept in engagement with the pilot pins 22*a*, 22*b* and 22*c*, respectively. Accordingly, any positional deviation of the plate-shaped workpiece 16 during the press forming thereof is prevented, resulting in the high forming accuracy over the entire press forming.

As discussed above, the hot press forming can be executed with the pilot openings 20*a*, 20*b* and 20*c* being kept in engagement with the pilot pins 22*a*, 22*b* and 22*c*. Accordingly, as compared with the case where these pilot pins 22*a*, 22*b* and 22*c* protrude/retract in every hot press forming process cycle, the cycle time required for the hot press forming process is shortened, resulting in improvement of forming efficiency. In addition to this, reduction of the movable parts decreases the maintenance work, resulting in reduction in the forming costs.

Further, in the present embodiment, the pilot pins 22*a*, 22*b* and 22*c* arranged fixedly on and integrally with the lower die 12, are not required to be able to protrude from and retract into the press die 10. Thus, the forming device including the press die 10 can be simply constructed at low cost.

Figure 4A:
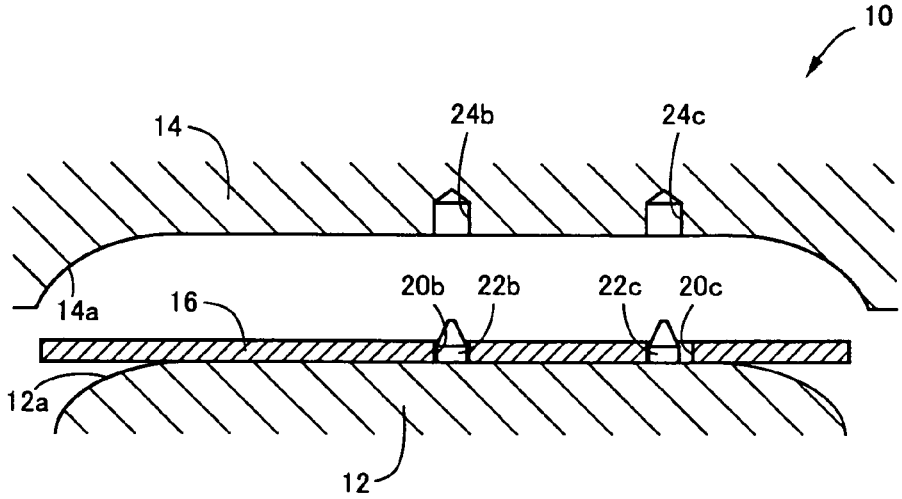
Figure 4B:
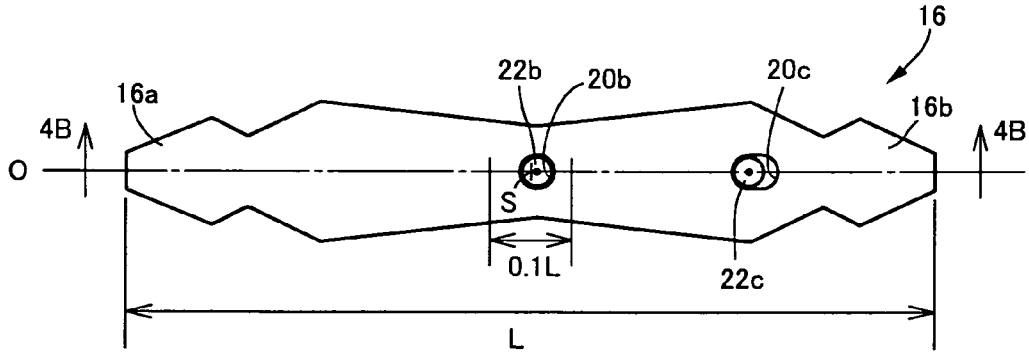

In the foregoing embodiment, a pair of the pilot openings 20*a* and 20*c* are provided as the claimed second positioning openings. However, as shown in FIGS. 4A and 4B, only one of the pilot openings 20*a* and 20*c* may be sufficiently provided. FIGS. 4A and 4B show a case where only the pilot opening 20*c* is provided as the claimed second positioning opening.

Figure 5A:
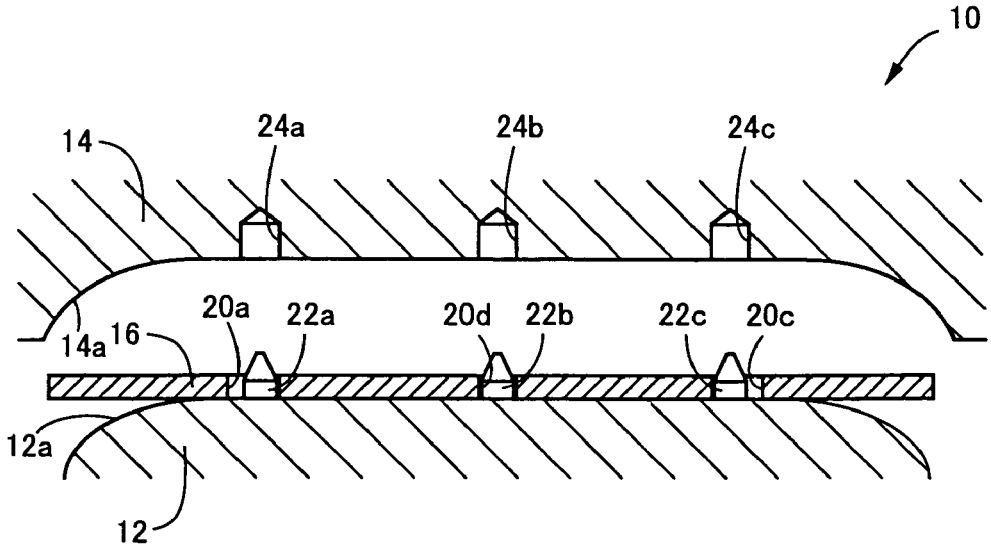
Figure 5B:
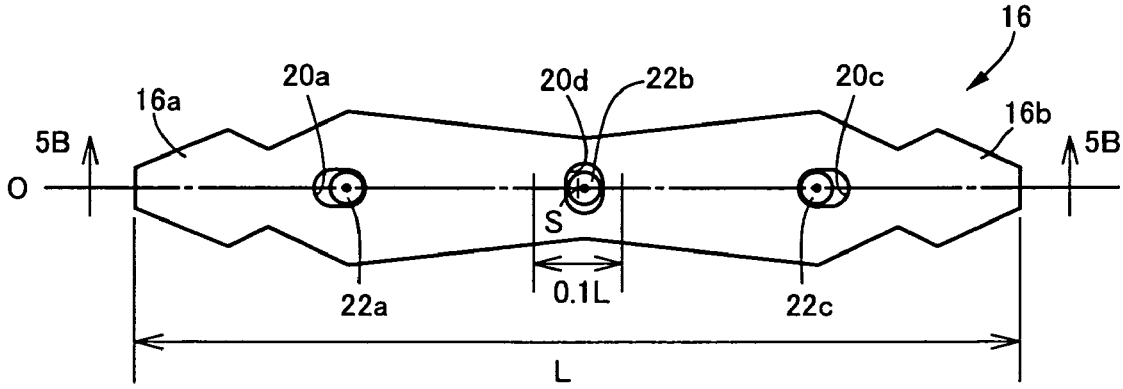

In the foregoing embodiment, the pilot opening 20*b* as the claimed first positioning opening has the true circular shape. However, as shown in FIGS. 5A and 5B, an elongate opening 20*d* that extends in the shorter direction can also be adopted. Even in this case, the engagement of the pair of pilot openings 20*a* and 20*c* with the pilot pins 22*a* and 22*c* can position the plate-shaped workpiece 16 in the shorter direction, so that the plate-shaped workpiece 16 can be also positioned at a predetermined position and in a predetermined posture.

While preferred embodiments of the present invention have been described with reference to the drawings, it should be noted that these embodiments are provided by way of illustration only. It will be apparent to those skilled in the art that various changes and modifications can be made to the present invention without departing from the scope thereof.

What is claimed is:

1. A plate-shaped workpiece positioning structure for hot press forming that, upon executing a hot press forming of a heated plate-shaped workpiece, positions the plate-shaped workpiece relative to a pair of press dies approaching to and separating away from each other, the positioning structure comprising:

a first positioning opening arranged in a geometrical center part of the plate-shaped workpiece, the first positioning opening engaging with a first positioning pin immovably fixed on one of the pair of press dies integrally therewith, to position the plate-shaped workpiece; and a second positioning opening arranged between the first positioning opening and a predetermined outer peripheral part of the plate-shaped workpiece and is formed in an elongate shape that extends along a line connecting the first positioning opening and the predetermined outer peripheral part, the second positioning opening engaging with a second positioning pin immovably fixed on one or other of the pair of press dies integrally therewith, to position the plate-shaped workpiece in a circumferential direction about the first positioning opening, and to allow contractional deformation of the plate-shaped workpiece toward the first positioning opening upon executing the hot press forming.

2. The plate-shaped workpiece positioning structure according to claim 1, wherein:

the heated plate-shaped workpiece has an elongated shape, the first positioning opening is arranged in a center part in a longitudinal direction of the plate-shaped workpiece, and engages with the first positioning pin to position the plate-shaped workpiece in the longitudinal direction thereof; and the second positioning opening is arranged between the first positioning opening and a longitudinally distal end of the plate-shaped workpiece and is formed in an elongate shape extending in the longitudinal direction, the second positioning opening engaging with the second positioning pin to position the plate-shaped workpiece in a shorter direction, and allowing the contractional deformation in the longitudinal direction of the plate-shaped workpiece toward the first positioning opening upon executing the hot press forming.

3. The plate-shaped workpiece positioning structure for hot press forming according to claim 2, wherein a pair of the second positioning openings are arranged at opposite positions in the longitudinal direction of the plate-shaped workpiece with interposing the first positioning opening therebetween, and engage with a pair of the second positioning pins immovably fixed on one or other of the pair of press dies integrally therewith, to position the plate-shaped workpiece in the shorter direction, and to allow contractional deformation of the plate-shaped workpiece in the longitudinal direction toward the first positioning opening upon the hot press forming.

4. The plate-shaped workpiece positioning structure for hot press forming according to claim 1, wherein the first positioning opening has a true circular shape with a fixed diameter.

5. The plate-shaped workpiece positioning structure for hot press forming according to claim 2, wherein the first positioning opening has a true circular shape with a fixed diameter.

6. The plate-shaped workpiece positioning structure for hot press forming according to claim 3, wherein the first positioning opening has a true circular shape with a fixed diameter.

7. The plate-shaped workpiece positioning structure for hot press forming according to claim 1, wherein one of the pair of press dies is a lower die, and other of the pair of press dies is an upper die.

8. The plate-shaped workpiece positioning structure for hot press forming according to claim 2, wherein one of the pair of press dies is a lower die, and other of the pair of press dies is an upper die.

9. An elongate plate-shaped workpiece subjected to a hot press forming in a heated state, by being sandwiched by a first press die on which a first positioning pin and a second positioning pin are immovably fixed integrally therewith, and a second press die on which a first pin escape hole for escaping the first positioning pin and a second pin escape hole for escaping the second positioning pin are provided and which relatively approaches to and is separated away from the first press die, the elongate plate-shaped workpiece comprising:

a first positioning opening arranged in a geometrical center part of the elongate plate-shaped workpiece and engaging with the first positioning pin to position the plate-shaped workpiece; and a second positioning opening arranged between the first positioning opening and a predetermined outer peripheral part of the elongate plate-shaped workpiece and formed in an elongate shape that extends along a line connecting the first positioning opening and the predetermined outer peripheral part, the second positioning opening engaging with the second positioning pin to position the plate-shaped workpiece in a circumferential direction about the first positioning opening, and to allow contractional deformation of the workpiece toward the first positioning opening upon executing the hot press forming in a heated state.

* * * * *